US006874908B2

(12) United States Patent
Sharrah et al.

(10) Patent No.: US 6,874,908 B2
(45) Date of Patent: Apr. 5, 2005

(54) FLEXIBLE BENDABLE FLASHLIGHT

(75) Inventors: Raymond L. Sharrah, Collegeville Borough, PA (US); Robert A. Kline, Douglas Township, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 10/144,594

(22) Filed: May 13, 2002

(65) Prior Publication Data

US 2003/0210543 A1 Nov. 13, 2003

(51) Int. Cl.[7] ..... F21L 11/00

(52) U.S. Cl. ..... 362/187; 362/198; 362/800; 362/119; 362/202; 362/199; 362/197; 362/203

(58) Field of Search ..... 362/198, 158, 362/800, 119, 120, 202, 203, 199, 197

(56) References Cited

U.S. PATENT DOCUMENTS

| | | | | |
|---|---|---|---|---|
| 1,369,644 A | * | 2/1921 | Forster | 362/190 |
| 2,467,954 A | * | 4/1949 | Becker | 362/190 |
| D166,073 S | | 3/1952 | Dunkelberger | |
| 2,648,762 A | | 8/1953 | Dunkelberger | |
| D185,496 S | | 6/1959 | Hansen | |
| 3,103,723 A | * | 9/1963 | Becker | 362/190 |
| 3,111,277 A | | 11/1963 | Grimsley | |
| 3,881,468 A | | 5/1975 | Foltz | |
| D238,604 S | | 1/1976 | Brindley | |
| 4,228,485 A | | 10/1980 | Hubbard et al. | |
| 4,290,095 A | | 9/1981 | Schmidt | |
| 4,346,329 A | | 8/1982 | Schmidt | |
| D268,442 S | | 3/1983 | Darmon | |
| 4,495,550 A | | 1/1985 | Visciano | |
| D283,645 S | | 4/1986 | Tanaka | |
| 4,733,337 A | | 3/1988 | Bieberstein | |
| 4,841,417 A | | 6/1989 | Maglica et al. | |
| D302,325 S | | 7/1989 | Charet et al. | |
| 4,967,330 A | * | 10/1990 | Bell et al. | 362/311 |
| 5,154,483 A | | 10/1992 | Zeller | |
| D341,220 S | | 11/1993 | Eagan | |
| D346,871 S | | 5/1994 | Zeller | |
| D349,354 S | | 8/1994 | Yau | |
| 5,369,556 A | | 11/1994 | Zeller | |
| 5,417,207 A | | 5/1995 | Young et al. | |
| D374,734 S | | 10/1996 | Esposito | |
| 5,571,279 A | | 11/1996 | Chiang | |
| D377,989 S | | 2/1997 | Marvin et al. | |
| D378,858 S | | 4/1997 | Kaiser | |
| 5,615,945 A | | 4/1997 | Tseng | |
| D379,540 S | | 5/1997 | Szymanski | |
| D379,541 S | | 5/1997 | Kaiser | |

(Continued)

FOREIGN PATENT DOCUMENTS

| | | |
|---|---|---|
| EP | 1 029 706 A2 | 8/2000 |
| EP | 1 029 706 A3 | 2/2001 |

OTHER PUBLICATIONS

AQUILA, "Cyclops Specification for Rechargeable Board", http://www.aquilapro.demo.co.uk/clip.html, Printed Jan. 14, 2003, 3 Pages.

Product Showcase, "Clipboard Light Last Up to 5,000 Hours", Printed Dec. 19, 2002, 1 Page.

*Primary Examiner*—Stephen Husar
*Assistant Examiner*—Anabel Ton
(74) *Attorney, Agent, or Firm*—Dann, Dorfman, Herrell & Skillman, P.C.

(57) ABSTRACT

A flashlight comprises a housing having, for example, a tapered portion and a hole at a forward end thereof with a flexible/bendable extension including a solid state light source extending through the hole at the forward end thereof. A switch, preferably in a tail cap, selectively connects the solid state light source and at least one battery in the housing in circuit for causing the solid state light source to produce light. The flexible extension preferably makes electrical contact with the housing and/or preferably includes an insulating cover having an end retained in the housing.

53 Claims, 9 Drawing Sheets

U.S. PATENT DOCUMENTS

D379,542 S 5/1997 Egashira
D380,061 S 6/1997 Swyst
D380,844 S 7/1997 Kaiser
D381,101 S 7/1997 Haberstich et al.
D381,445 S 7/1997 Linnane
D381,446 S 7/1997 Kaiser
D381,447 S 7/1997 Haberstich et al.
D382,075 S 8/1997 Swyst
D383,231 S 9/1997 Kaiser
D385,637 S 10/1997 Rombough
D387,454 S 12/1997 Kaiser
5,707,137 A 1/1998 Hon
D390,985 S 2/1998 Shiau
5,716,121 A 2/1998 Dubois
5,717,276 A 2/1998 Hsu
D392,758 S 3/1998 Cedarberg, III
5,722,764 A 3/1998 Jou
D394,721 S 5/1998 Santarsiero
D403,451 S 12/1998 Ting
D407,508 S 3/1999 Chiu
5,975,712 A 11/1999 Shiao
D418,235 S 12/1999 Houplain
6,000,809 A 12/1999 Belo
6,004,004 A 12/1999 Altman et al.
6,007,214 A * 12/1999 Shiao ..... 362/120
D419,704 S 1/2000 Ting
D429,534 S 8/2000 Sengsouvanh et al.
D430,321 S 8/2000 Sharrah
6,280,050 B1 8/2001 Bird et al.
D452,024 S 12/2001 Sharrah
6,428,179 B1 * 8/2002 Saffron et al. ..... 362/118
6,491,408 B1 12/2002 Cooper et al.
RE38,014 E 3/2003 Bieberstein
6,575,593 B2 * 6/2003 Krietzman ..... 362/199
6,680,844 B2 * 1/2004 Kim ..... 361/683

* cited by examiner

FLEXIBLE BENDABLE FLASHLIGHT

The present invention relates to a flashlight, and in particular to a flashlight having a flexible and/or bendable lighted end.

Flashlights are available in a wide variety of shapes and sizes, and tailored to a particular use or situation. However, two desires that continue to indicate the need for improved flashlights include the desire for small flashlights and longer useful life. For example, there is a desire for a flashlight that is of a size and shape to conveniently fit in a pocket, e.g., a shirt pocket, and that can illuminate small and difficult to reach places. In addition, there is a desire for a flashlight that has a bright light and that operates for a long time before needing to replace or recharge the battery. Also, consumers also want such flashlights to be durable and available at a reasonable cost.

Prior art pocket lights such as a typical pen-shaped light typically are about 1.3 to 2 cm in diameter and are quite heavy, principally due to the size and weight of the type AA (about 1.4 cm diameter) or type AAA (about 1 cm diameter) batteries therein. It would be desirable to have a flashlight of about 1 cm or less in diameter, which is closer to the diameter of typical pens and pencils also kept in a person's pocket. A further advantage of a smaller-diameter flashlight is the ability to shine the light into small spaces.

Prior art flashlights typically employ filament-type lamps that have a filament that is electrically heated to glow to produce light, wherein the filament is suspended between supports. Typical filaments tend to be fragile, and often more so when they are heated to glowing. As a filament is used, the filament material may thin or become brittle, thereby increasing its susceptibility to breakage. Even high-light-output lamps such as halogen and xenon lamps employ a heated filament, albeit a more efficient light producer than is a conventional incandescent lamp filament. A solid-state light source, such as a light-emitting diode (LED), for example, does not have a heated filament and so is not subject to the disadvantages associated with lamp filaments, and such LEDs are now available with sufficiently high light output as to be suitable for the light source for a flashlight.

The desire for a small-diameter flashlight to illuminate difficult to reach spaces would in general be advanced if the lighted end of the flashlight were flexible and/or bendable to a desired shape or form. Accordingly, there is a need and/or desire for flashlight that has a flexible and/or bendable lighted end.

To this end, the flashlight of the present invention comprises a housing having a hole and an elongated bendable member extending through the hole in the housing and having a light source at an end thereof distal the housing. Securing means disposed around the elongated bendable member interior the housing secures the bendable member in the housing and a switch selectively connects the light source and the battery in circuit via conductors of the elongated bendable member for causing said light source to produce light.

BRIEF DESCRIPTION OF THE DRAWING

The detailed description of the preferred embodiments of the present invention will be more easily and better understood when read in conjunction with the FIGURES of the Drawing which include.

Figure 1:
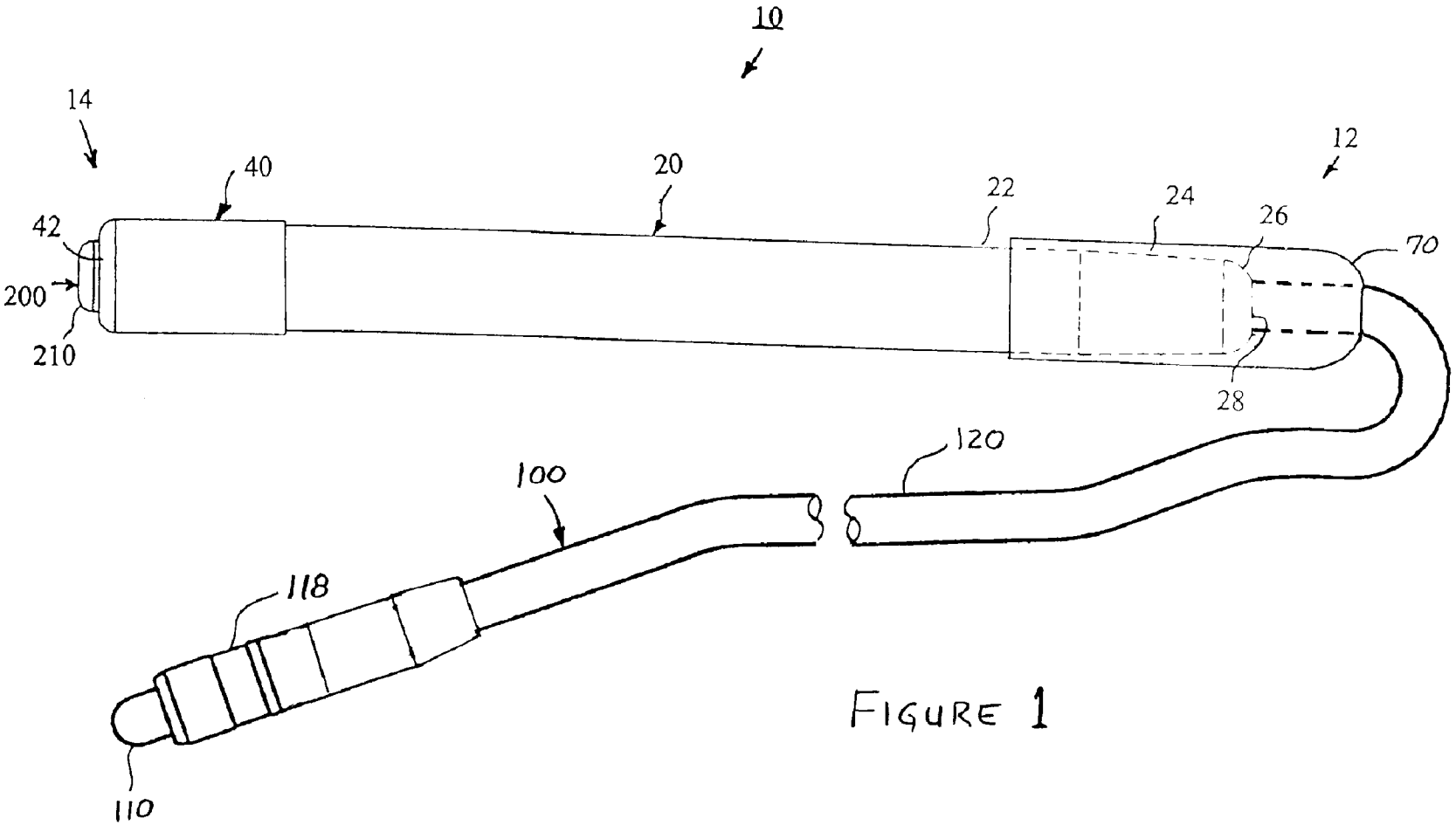
FIG. 1 is a side view of an example embodiment of a flashlight including an example embodiment of the present invention.

In the Drawing, where an element or feature is shown in more than one drawing figure, the same alphanumeric designation is used to designate such element or feature in each figure, and where a closely related or modified element is shown in a figure, the same alphanumerical designation primed may be used to designate the modified element or feature.

DESCRIPTION OF THE PREFERRED EMBODIMENT

FIG. 1 is a side view of an example embodiment of a flashlight 10 including an embodiment of the present invention. Flashlight 10 has a forward or head end 12 at which light is produced by a light source assembly 100 including a solid-state light source 110 such as an LED, and a rearward or tail end 14 at which is a tail switch assembly 200 including a pushbutton 210. Hollow cylindrical housing 20 of flashlight 10 has an elongated hollow cylindrical portion 22 and a hollow reduced inner diameter portion 24, for example, a tapered portion 24, proximate head end 12. Housing 20 is formed into a generally rounded forward end 26 at head end 12 and has a circular hole therein through which light source assembly 100 projects in a forward direction.

Light source assembly 100 comprises an elongated flexible and/or bendable member 120 extending from the forward end 26 of housing 20 and having a solid state light source 110 at the distal end of flexible member 120. Member 120 preferably has sufficient "stiffness" to remain in essentially the shape into which it is bent and/or formed, but may be "flexible" to the point that its shape changes to a greater or lesser degree under gravity, e.g., it could be "floppy."

Preferably, but optionally, plastic sleeve 70 may be provided to overlie end 12 of housing 20 and a base end of flexible member 120 of light source assembly 100 for limiting bending thereof proximate hole 28. Member 120 is flexible and/or bendable in that it may be repeatedly formed into virtually any desired shape or form. Plastic sleeve or body 118 overlies the end of flexible member 120 and the base of light source 110 to enclose and support the connection of leads of light source 110 to conductors of member 120. The other end of light source assembly 100 is disposed within housing 20 wherein the conductors of light source 100 are connected in electrical circuit with one or more batteries disposed within housing 20 for causing light source 110 to provide light.

Cylindrical tail cap 40 overlies cylindrical housing 20 at the tail end 14 of flashlight 10 and has a circular hole 42 therein through which pushbutton 210 of tail switch assembly 200 projects in a rearward direction. Light source 110 is turned on by either depressing pushbutton 210 or by rotating tail cap 40 further onto housing 20.

Figure 2:
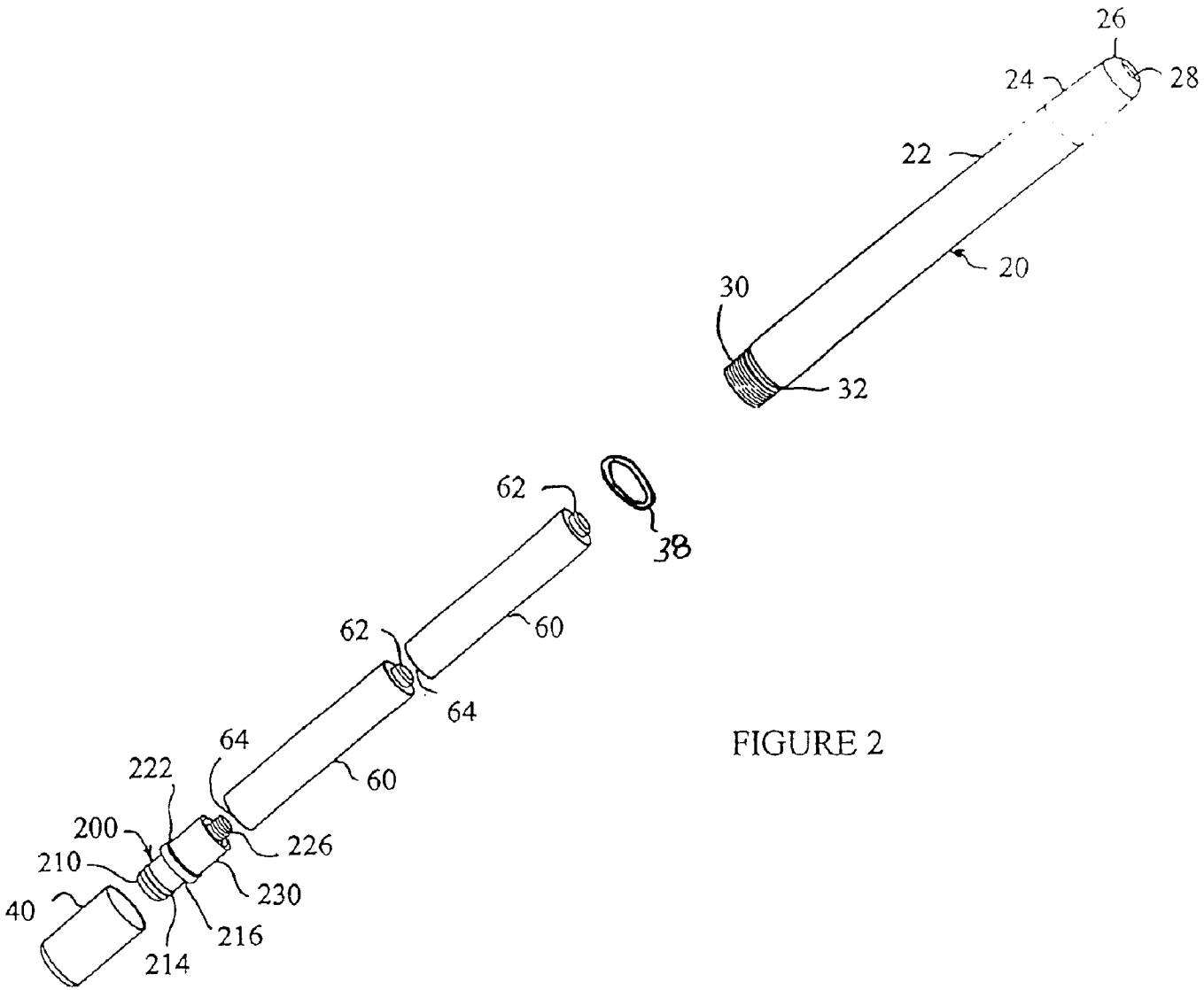
FIG. 2 is an exploded isometric view of part of the flashlight embodiment of FIG. 1.

FIG. 2 is an exploded isometric view of part of the flashlight 10 of FIG. 1 illustrating the external and internal components thereof. Hollow cylindrical housing 20 includes an elongated hollow cylindrical portion 22 and a hollow reduced inner diameter portion 24, for example, a tapered portion 24, proximate rounded forward end 26 thereof in which is formed circular hole 28 through which the flexible member 120 of light source assembly 100 projects. Tubular housing 20 includes external threads 30 at the rearward end thereof for engaging the internal threads (not visible in FIG. 2) on the inner surface of tail cap 40. Housing 20 has a circumferential groove 32 forward of threads 30 for receiving a resilient O-ring 38 therein that provides a water-resistant seal between housing 20 and tail cap 40.

Internal components that slip inside the hollow cylindrical housing 20 include light source assembly 100 and batteries 60. Batteries 60 each include a positive terminal 62 and a negative terminal 64 and are connected in series to provide a source of electrical energy for energizing light source 110 to cause it to produce light. Typically, two batteries 60 (as illustrated) or three batteries 60 are employed, although a greater or lesser number could be employed by appropriately lengthening or shortening the length of housing 20. Preferably, batteries 60 are of the type AAAA alkaline cells which provide a voltage of about 1.2–1.5 volts and have a diameter of about 0.8 cm or less. As a result, flashlight 10 has an outer diameter of only about 1 cm (about 0.38 inch), and is 12.6 cm (about 4.95 inches) long for a two-battery flashlight and 16.8 cm (about 6.6 inches) long for a three-battery flashlight, and operates for about 10 hours or more on a set of batteries.

Preferably, solid state light source 110 includes a light-emitting diode (LED) that produces blue or white light and three batteries 60 are employed disposed in housing 20. While two single cell batteries are illustrated, and three single cell batteries are preferred, the number of battery cells required to provide a suitable voltage for light source 110 may be individually packaged or two or more battery cells may be disposed in a common package. As is common, the term battery as used herein may include one or more battery cells.

The small outer diameter of flashlight 10 advantageously permits flashlight 10 to be "pocket-sized" in that it is of a size that permits it to be carried in a pocket or pouch, if so desired, although it need not be. Flexible and/or bendable member may be formed to be positioned generally along housing 20, as may be convenient when flashlight 10 is placed in a pocket or a small case.

At the rearward or tail end 14 of flashlight 10, tail switch assembly 200 fits inside the central cavity of tail cap 40 with circular pushbutton 210 of tail switch assembly 200 projecting through circular hole 42 in the rearward end thereof. Resilient O-ring 214 on pushbutton 210 provides a water-resistant seal between pushbutton 210 and tail cap 40 when pushbutton 210 is installed therein with O-ring 214 bearing against the interior surface of tail cap 40 proximate circular hole 42 therein.

Selective electrical connection between negative terminal 64 of rearward battery 60 and the rearward end metal housing 20 is made via outwardly extending circular metal flange 222 which is electrically connected to coil spring 226. When push button 210 is depressed or when tail cap 40 is screwed further onto threads 30 of housing 20 moving tail switch assembly 200 forward relative to housing 20, metal flange 222 comes into electrical contact with the rearward annular surface of cylindrical housing 20, thereby to complete an electrical circuit including batteries 60 and light source 110, e.g., via conductors of flexible member 120, to the end of selectively applying electrical potential to solid state light source 110 to cause it to emit light.

Figure 3A:
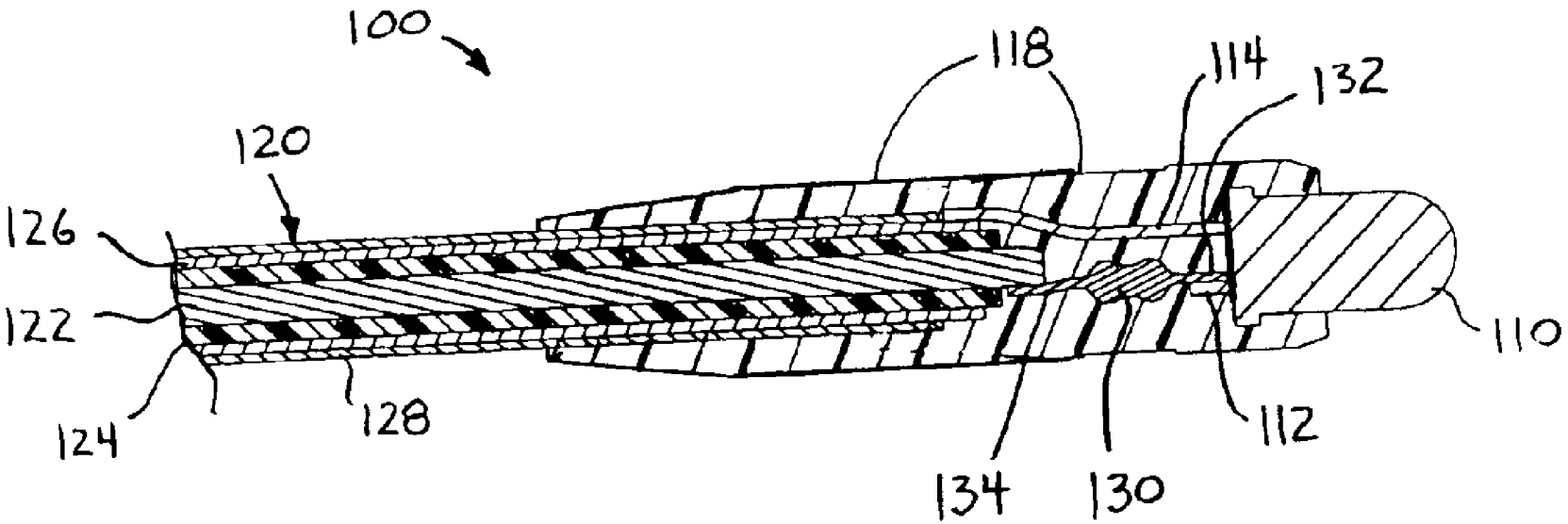
FIGS. 3A and 3B are side cross-sectional views of respective end portions of the flexible lighted end of the flashlight of FIG. 1.

FIG. 3A is an enlarged side cross-sectional view of a light source end portion of flexible light source assembly 100 of flashlight 10 of FIG. 1. Solid state light source 110 includes two electrical leads 112, 114 that are connected to electrical conductors 122 and 126 of flexible member 120. For example, lead 112 is connected to center conductor 122 and lead 114 is connected to outer conductor 126 of flexible member 120 where flexible member 120 includes, for example, a coaxial cable. In coaxial cable 120, electrical insulation 124 overlies center conductor 122 to space outer conductor 126 radially apart therefrom, thereby to define the physical spatial relationship between conductors 122, 126 and to electrically insulate them one from the other. An insulating jacket 128 overlies outer conductor 126 for insulation and/or physical protection and/or appearance.

Flexible member 120 is preferably a length of coaxial cable, such as standard coaxial cable, e.g., type RG-1, having a solid copper center conductor 122 and a braided copper wire cylindrical outer conductor 126, and plastic insulation 124 and a plastic jacket 128. Center conductor 122 is preferably a solid copper conductor that is flexible and bendable and yet is sufficiently stiff to cause coaxial cable 120 to substantially retain whatever shape or form it may be bent, formed or urged into, at least until bent, formed or urged into a different shape. Center conductor 122 may be of increased diameter to increase the tendency of cable 120 to retain a desired shape.

Light source assembly 100 includes a solid state light source 110, preferably a light-emitting diode (LED), at the end thereof distal housing 20. LEDs are available to emit light of one of a variety of colors, e.g., white, red, blue, amber, or green, and have extremely long expected lifetimes, e.g., 100,000 hours. LED light source 110 is disposed within a body 118, preferably a molded plastic sleeve, that surrounds and supports the base of light source 110 and its leads 112, 114. Molded body 118 is preferably elongated so as to overlie outer cover 128 of cable 120 so that it does not easily work out or separate from under body 118 with bending of bendable member 120 of light source assembly 100. Body 118 is preferably a rigid dielectric material such as a moldable plastic, such as a thermoplastic, e.g., polyvinyl chloride (PVC), nylon or Santoprene plastic.

One electrical lead 114 of light source 110 electrically connects to outer conductor 126 of coaxial cable 120 through which electrical connection is made to housing 20. The other electrical lead 112 thereof electrically connects to center conductor 122 of cable 120 through which electrical connection is made to the positive terminal 62 of forward battery 60, thereby to complete an electrical circuit between battery 60 and metal housing 20 through LED light source 110. One or the other of the connections of leads 112 and 114 to a respective one of conductors 122 and 126 is preferably made through electrical device 130 also disposed within body 118. To that end lead 132 of electrical device 130 connects to one of leads 112, 114 and the other electrical lead 134 thereof connects to make electrical connection with one or the other of conductors 122, 126. In the example illustrated, electrical device connects lead 112 and conductor 122.

Electrical device 130 is preferably an electrical resistor with one of its leads 134 connecting via conductor 122 to battery 60 and the other of its leads 132 connected to lead 112 of LED light source 110 to limit the current that flows therethrough, thereby to extend the life of LED light source 110 and of batteries 60. Resistor 130 is preferably a carbon film resistor, and other types of resistors can be utilized. If a reverse potential were to be applied to LED light source 110, as could occur if batteries 60 were installed backwards, the diode action of LED light source 110 and resistor 130 prevent excess current flow in LED light source 110 that might otherwise cause the light-emitting diode therein to become degraded, damaged or burned out.

Alternatively, electrical device 130 may connect outer conductor 126 and lead 112 of light source 110; any particular connection arrangement being suitable if the polarity of LED light source 110 is proper with respect to the polarity of battery or batteries 60 for biasing light source 110 to produce light.

Figure 3B:
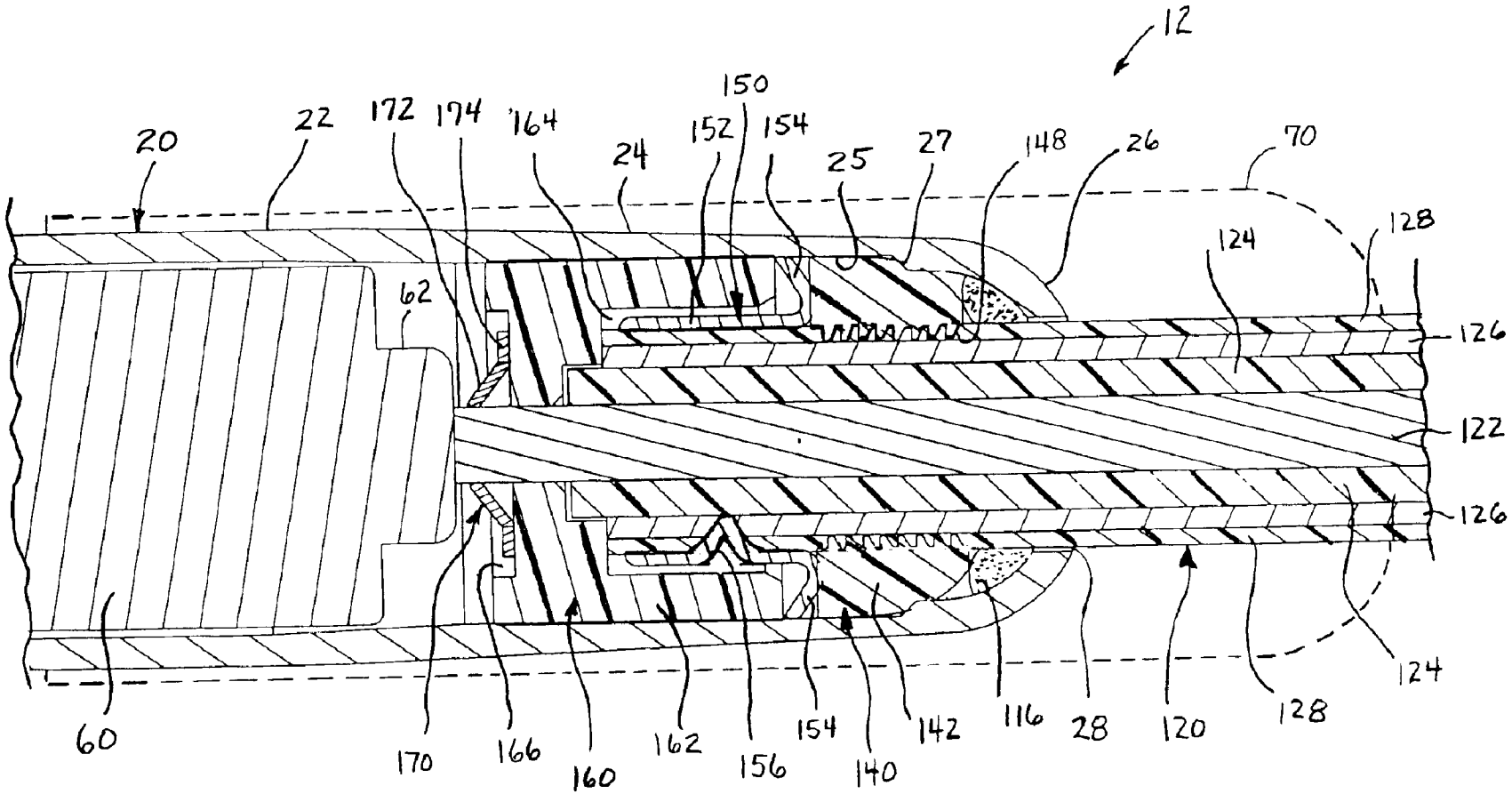
Figure 3C:
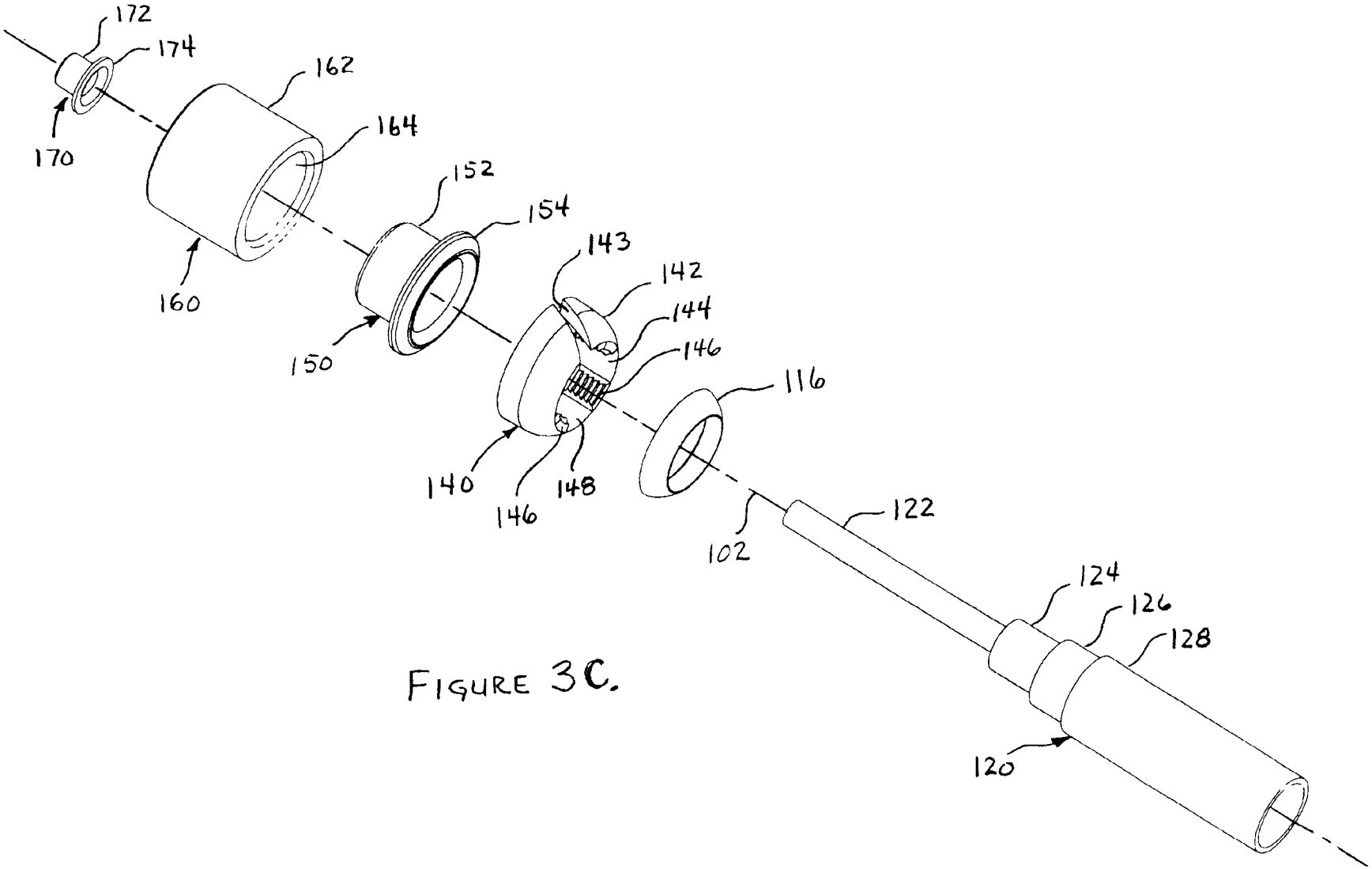
FIG. 3C is an exploded isometric view of one end thereof.

FIG. 3B is an enlarged side cross-sectional view of a base end portion of flexible light source assembly 100, and is considered in conjunction with FIG. 3C which is an exploded isometric view of an example embodiment of the base end of light source assembly 100. The base end of light source assembly 100 is disposed in end 12 of housing 20 of flashlight 10 of FIG. 1 and includes, for example, O-ring 116, split collar 140, eyelet 150, fitting 160 and rear eyelet 170, for securing flexible cable 120 in housing 20 and providing electrical connections to conductors 122, 126 of light source assembly 100.

O-ring 116, split collar 140, eyelet 150, fitting 160 and rear eyelet 170 fit over a base end of flexible coaxial cable 120 at which the insulation layer 124 is stripped back from the end of center conductor 122, outer conductor 126 and outer jacket 128 together are stripped back slightly further. Alternatively, outer jacket 128 may be stripped back slightly further than is conductor 126. At least eyelets 150 and 170 are electrically conductive, preferably of a metal, such as brass, copper, beryllium copper, aluminum or stainless steel. Split collar 140 and fitting 160 are preferably of insulating material, such as a moldable plastic, e.g., an acetyl plastic, such as Delrin plastic available from E.I duPont de Nemoirs & Company of Wilmington, Del. O-ring 116 is preferably a resilient material, such as a rubber, neoprene or silicone material.

Cylindrical body portion 152 of metal eyelet 150 is punch swaged 156 to make electrical connection to outer conductor 126 and rear metal eyelet 170 is swaged to center conductor 122 to retain the foregoing items on cable 120. When light source assembly is pressed into the internal bore 25 of housing 20, annular flange 154 of metal eyelet 150 contacts the interior surface 25 of housing 20 to make electrical connection therewith. Thus, electrical connection is provided between outer conductor 126 of flexible member 120 and housing 20. The end of center conductor 122 abuts and is in electrical connection to terminal 62 of battery 60 disposed within housing 20.

Cable retainer 140, also referred to as collar or split collar 140, has an annular body 142 with a central opening or axial bore 144 therethrough. Annular body 142 is split at longitudinal slot or groove 143 so that its outer and inner diameter will decrease as split collar 140 is compressed so that slot or groove 143 closes. In particular, the outer diameter of collar 140 is sized to be slightly larger than the inner diameter of housing 20 so that when collar 140 is pressed into housing 20, e.g., so as to abut shoulder 27 near tip 26 of housing 20, slot 143 partly or totally closes to reduce the diameter of central opening 144, thereby to bear or press against outer jacket 128 of cable 120 and to tend to secure cable 120 in housing 20. The compression of split collar 140 within housing 20, as well as the engaging of flange 154 of metal contact eyelet 150 against interior surface 25 of housing 20, make light source assembly 100 a press fit therein.

While pressure created by housing 20 compressing collar 140 may alone be sufficient to secure cable 120, and specifically jacket 128 thereof, within housing 20, it is preferred that plural projections 146 extend radially inward from the inner surface of central opening 144. Projections 146 may be one or more circumferential raised rings, or may be segments of one or more circumferential raised rings, or may be pyramidal or trapezoidal teeth, or any other convenient shape. For example, four sets or groups of segments of raised circumferential rings, about 90° apart radially, and projecting a distance greater than the thickness of outer jacket 128 so as to press jacket 128 into braided outer conductor 126, have been found satisfactory.

Fitting 160 is preferably cylindrical and cylindrical body 162 thereof fits within housing 20, e.g., for centering conductor 122 of cable 120. Fitting 160 has an axial central bore 164 from a forward end thereof that is of stepped depth to correspond to the dimensions to which coaxial insulator 124, outer conductor 126 and outer jacket 128 of coaxial cable 120 are stripped, and fitting 160 also has an axial central through hole to receive center conductor 122 thereof. The rearward end of fitting 160 preferably has a central circular recess 166 to receive and generally center flange 174 of metal eyelet 170, the cylindrical body 172 of which is swaged to grip center conductor 122. Fitting 160 also tends to hold center conductor 122 and swaged eyelet 170 in a desired, e.g., centered, radial position while tending to hold eyelet 150 and split collar 160 in a desired axial position.

Assembly of light source assembly 100 and housing 20 into flashlight 10 is as follows. Flexible cable 120 is assembled with light source 110 and resistor 130 and plastic body 118 is molded thereon. Sleeve 70, if utilized, is then slipped onto cable 120 and cable 120 is inserted through hole 28 in the forward end of housing 20 so that the base end of cable 120 extends beyond the threaded end thereof. O-ring 116, split collar 140 and eyelet 150 are slipped onto the end of cable 120 and positioned thereon. Cylindrical body 152 of metal eyelet 150 is puncture swaged to cable 120 with the puncture causing the metal thereof to penetrate outerjacket 128 and come into electrical contact with outer conductor 126. Fitting 160 end eyelet 170 are positioned on cable 120 and cylindrical body 172 of eyelet 170 is swaged to center conductor 122. Light source assembly 100 is then pushed into housing 20 and is pressed into position in the bore at the forward end 24 thereof. As light source assembly is pressed into position, split collar 140 is compressed radially so that teeth or projections 146 thereof engage outerjacket 128 to hold it in the desired position, and flange 154 of metal eyelet 150 engages the inner surface 25 of housing 20 to make electrical connection thereto. Split collar 140 abuts shoulder 27 of housing 20 and O-ring 116 is compressed at the forward end thereof to provide an internal seal where cable 120 passes through hole 28. Assembly of flashlight 10 is completed by placing batteries 60 into housing 20 and screwing tail cap 40, which includes a pushbutton switch, thereon.

Alternatively, O-ring 116, split collar 140, eyelet 150, fitting 160 and eyelet 170 may be slipped onto cable 120, positioned thereon, and eyelet 170 may be swaged to center conductor 122 and metal eyelet 150 may be puncture swaged to cable 120 to make electrical contact with outer conductor 126. Cable 120 with the foregoing items at the base thereof may then be pushed into housing 20 from threaded end 30 to extend forwardly through hole 28 and be pressed into position abutting shoulder 27 in the bore at the forward end 24 of housing 20. Light source 110 and resistor 130 may then be assembled with flexible cable 120 and plastic body 118 may then be molded thereon. Sleeve 70, if utilized, may be slipped onto cable 120 prior to assembly of light source 110 and resistor 130 therewith. Assembly of flashlight 10 is completed as described above. It is noted that this assembly sequence allows the length of flexible member 120 to be made either longer or shorter than the length of housing 20.

Optional, but preferred, plastic sleeve 70 is slipped over the end 24, 26 of housing 20 to tend to reduce any tendency of outer jacket 128 to move and possibly to either be damaged where it exits hole 28 or to pullout of hole 28. Sleeve 70 may be a plastic material such as a moldable plastic, such as a thermoplastic, e.g., Santoprene plastic, polyvinyl chloride (PVC), nylon or other plastic. Resilient O-ring 116 fits over flexible member 120 of light source assembly 100 to provide a water-resistant seal between light source assembly 100 and housing 20 when light source assembly 100 is installed forward within housing 20 with O-ring 116 bearing against the internal surface thereof proximate circular hole 28 and the forward surface of collar 140.

Figure 4:
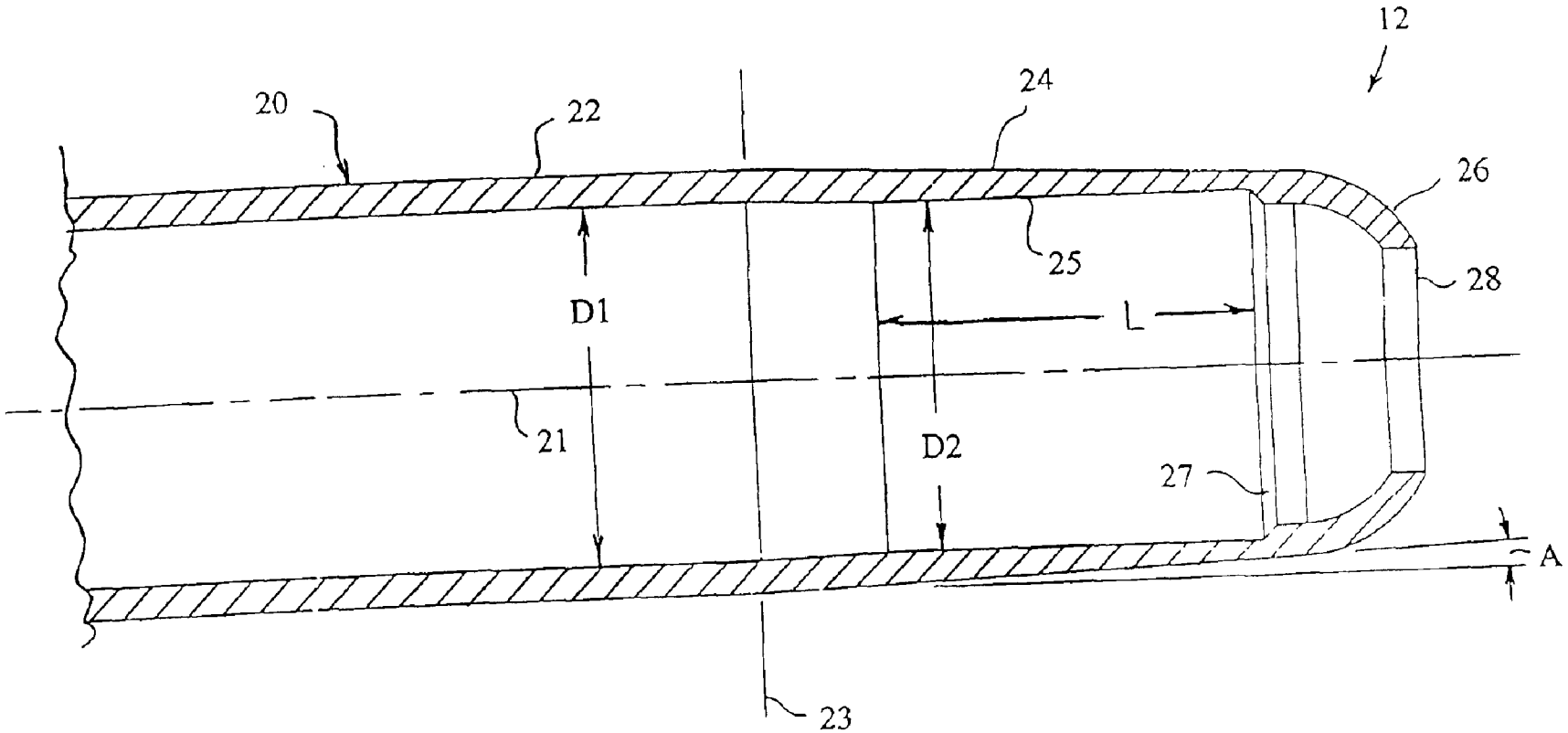
FIG. 4 is an enlarged side cross-sectional view of a portion of the barrel of the flashlight of FIG. 1.

FIG. 4 is an enlarged side cross-sectional view of a forward portion of housing 20 of the flashlight 10 of FIG. 1. Housing 20 is preferably formed from a cylindrical aluminum tube or tube stock, such as an extruded cylindrical tube, preferably an aluminum tube having an outer diameter of about 1 cm or less, as follows. An length of aluminum tube is cut to a length slightly longer than the axial length of housing 20 and one end thereof forward of break line 23 is roll formed, preferably cold roll formed, so as to have a slight narrowing taper, thereby forming tapered portion 24 of housing 20 having an inner diameter that is less than the inner diameter of the remainder of housing 20 proximate the forward or head end 12 thereof. A taper angle A of less than about 5° from the longitudinal center axis 21 is desirable. In fact, for an about 1 cm diameter tube, a taper of about 2° is preferred. Housing 20 is further roll formed at the head end 12 of tapered portion 24 to form a rounded forward end 26 having a narrowed-diameter opening therein that is trimmed, such as by drilling or boring, to provide circular hole 28 coaxially with housing centerline 21. The roll forming of tapered portion 24 and rounded end 26 may be performed in a single operation. Housing 20 is typically coated with the preferred anodized or painted or other finish.

Because the preferred anodized finish is not electrically conductive, it must be removed from or not applied to locations on housing 20 at which electrical connection is to be made. To this end, the reduced inner diameter tapered forward portion 24 of housing 20 provides a particular advantage, it being noted that the rolling tapers both the outer and inner surfaces of tapered portion 24. Because the aluminum tube is tapered only at its forward end, the interior diameter of housing 20 is of uniform inner diameter D1 over its entire length except at tapered portion 24 forward of break line 23 where it has a reduced diameter. Thus, a reamer or boring tool of diameter D2 greater than the inner diameter of the reduced inner diameter portion 24 and less than the inner diameter D1 of the remainder of housing 20 will remove the insulating coating in the reduced inner diameter portion 24 of housing 20 and form a ridge or shoulder 27 at the forward end thereof. A housing 20 so formed may have a cylindrical outer shape or other outer shape, as is desired. The clearance reamer or other boring tool is inserted into the interior of housing 20 from the tail end 14 thereof and through cylindrical portion 22 thereof and includes a cutting head that cuts a bore of diameter D2 that is less than the inner diameter D1 of cylindrical portion 22, and so does not cut within portion 22 and remove the electrically insulating coating therefrom, and may include a non-cutting guide of a diameter greater than D2, but less than D1, rearward of its cutting head for centering the boring tool substantially coaxially along centerline 21 of housing 20.

As the clearance reamer or boring tool advances forwardly into tapered portion 24, it cuts a cylindrical bore 25 of diameter D2 interior to tapered portion 24, thereby cutting through the non-conductive anodized coating to expose the conductive aluminum metal of housing 20, to provide a contact area to which an electrical conductor, e.g., eyelet 150, of light source assembly 100 makes electrical contact when light source assembly 100 is inserted into housing 20 and advanced forwardly therein until split collar 140 of light source assembly 100 abuts, i.e. is proximate to, shoulder 27 and flexible member or cable 120 thereof extends through hole 28. The diameter D2 and length L of bore 25 are selected to provide sufficient exposed aluminum contact surface in bore 25 while leaving sufficient thickness in the forward end of the wall of tapered portion 24 of housing 20. Typically, housing 20 has an outer diameter of about 0.95 cm, an inner diameter of about 0.80 cm, and bore 25 has a diameter D2 of about 0.79 cm and a length L of about 0.9–1.0 cm.

The rearward end 14 of housing 20 has external threads 30 formed on the outer surface thereof, such as by machining or cold forming, or by the pressing of a threaded insert therein, and the anodized finish is removed from rearward end of housing 20, such as by machining or grinding, so as to expose the metal of housing 20 and/or the metal insert to provide a location to which circular flange 222 of metal ferrule 220 can make electrical contact.

Alternatively, the boring tool utilized to cut bore 25 in tapered portion 24 may also include a second cutting head of lesser diameter located forward of the cutting head that cuts bore 25, wherein the second more-forward cutting head is utilized to bore hole 28 in a single operation with the cutting of bore 25.

While housing 20 has been described in terms of tapered portion 24 of housing 20 having an interior surface that is tapered so that a reamer or boring tool may be utilized to remove the electrically insulating anodize coating therefrom, any form of housing 20 having a reduced inner diameter portion 24 near the forward end 12 thereof that a reamer or boring tool or other like tool may be utilized to remove the electrically insulating coating therefrom. Thus, a housing having a reduced inner diameter portion 24 is satisfactory irrespective of whether or not the exterior surface of the reduced inner diameter portion 24 of housing 20 is of the same, smaller or larger outer diameter than is the rest of housing 20 and irrespective of whether the shape of the outer surface of reduced inner diameter portion 24 of housing 20 is the same as or different from the shape defined by the inner surface of reduced inner diameter portion 24 thereof.

Accordingly, housing 20 may be formed by thin-wall impact extrusion wherein a blank or preform of metal such as aluminum is deep drawn to form a cylindrical housing 20 having a cylindrical interior bore that is of a given diameter except at the forward end thereof at which it has a reduced inner diameter. The reduced inner diameter portion may be a tapered interior shape or may be a smaller diameter cylindrical bore, for example. In impact extrusion, which can be utilized in quickly forming relatively deep closed-ended metal objects such as food and beverage cans and cigar tubes, a blank of material to be extruded is forced into a cavity tool that has a cavity of substantially the same size and shape as the desired outer shape of the extruded object to determine the outer shape thereof. The blank is forced into the cavity of the cavity tool by a core tool that has an outer shape that is substantially the same size and shape as the desired inner surface of the extruded object. The shape and size of the elongated closed-ended tube so formed by impact extrusion is defined by the generally cylindrical gap between the cavity tool and the core tool when the core tool is fully driven into the cavity of the cavity tool, similarly to a mold. The extruded object is removed from the cavity and core tools and is trimmed to the desired length of the extruded object.

Housing 20 formed by impact extrusion is removed from the cavity and core tools and the rearward end thereof is cut to the desired length. The resulting extruded hollow tube is then coated with an insulating coating such as an anodize coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by thin wall impact extrusion may have a cylindrical outer shape or other outer shape, as is desired. Where an impact extruded housing 20 is of long length, as is the case, for example, where three or more batteries 60 are housed therein, a threaded bushing is typically pressed into or onto the rearward end thereof to provide threads 30 for engaging tail cap 40.

Alternatively, housing 20 may be formed by boring or drilling an interior bore into a solid piece of material, such as a rod or bar of aluminum or other metal, for example. The drilling or boring of such deep small-diameter holes is usually referred to as "gun boring." The drilling or boring tool can have a smaller-diameter forward portion and a larger-diameter rearward portion so as to drill or bore a hole having a reduced inner diameter forward portion 24, which forward portion 24 may be a cylindrical bore or a tapered bore or other reduced inner diameter bore. Housing 20 is then coated with an insulating coating such as an anodize coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by gun boring may have a cylindrical outer shape or other outer shape, as is desired.

Figure 5:
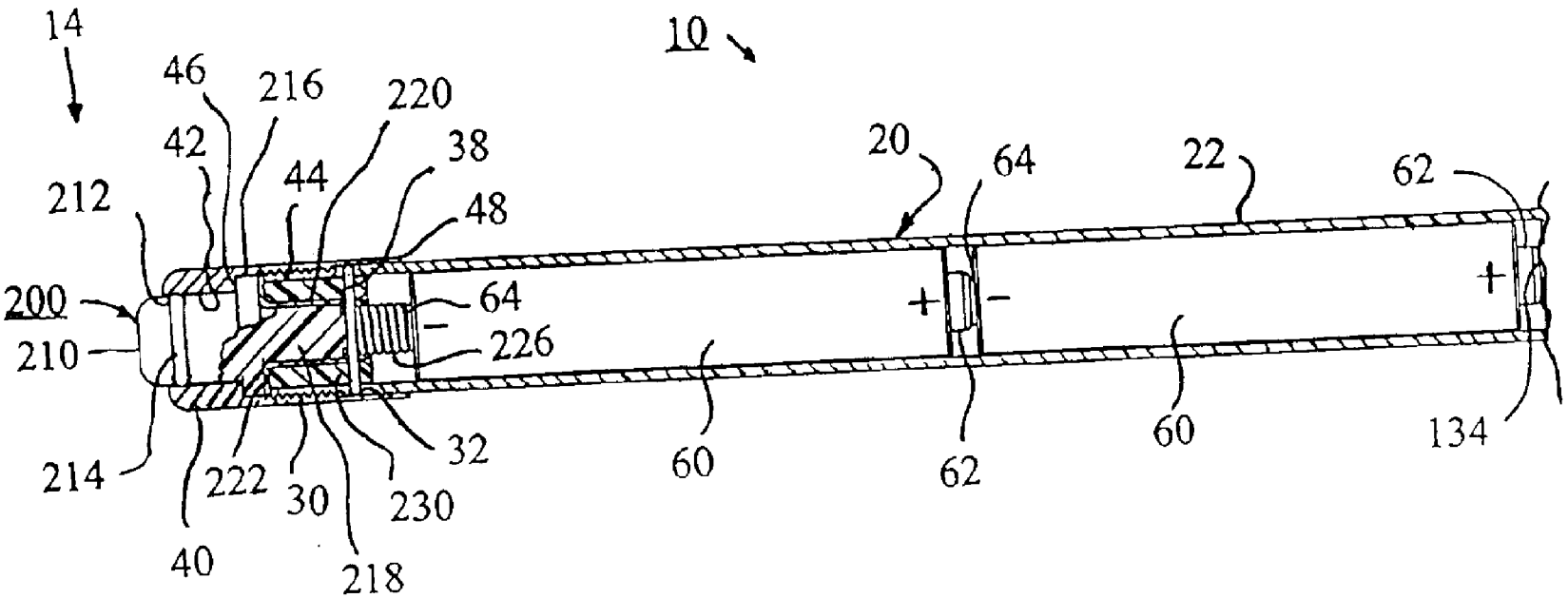
FIG. 5 is a side cross-sectional view of part of the flashlight of FIG. 1.

FIG. 5 is a side cross-sectional view of the flashlight 10 of FIG. 1 showing the relative positions of the external and internal components thereof when tail cap 40 is screwed onto threads 30 of housing 20 sufficiently to cause metal flange 222 to contact the rear end of housing 20, thereby to energize light source 110 to produce light as described above. Switch assembly 200 is free to move axially forward and rearward within housing 20 and tail cap 40, and does so under the urging of coil spring 226 and pressure applied to pushbutton 210. Unscrewing tail cap 40 moves tail cap 40 rearward and allows switch assembly 200 therein to also move rearward under the urging of spring 226, thereby breaking contact between metal flange 222 and the rear end of housing 20 and breaking the electrical circuit including batteries 60 and LED light source 110, thereby to de-energize light source 110 to stop the producing of light. Momentary switching (or blinking) action obtains from depressing/releasing pushbutton 210 when tail cap 40 is unscrewed slightly from the position illustrated in FIG. 5 and continuous on/off operation obtains by screwing tail cap 40 onto/away from housing 20 sufficiently to cause light assembly 110 to produce/not produce light.

Coil spring 226 urges batteries 60 forward causing their respective positive terminals 62 and negative terminals 64 to come into electrical contact and TO URGE terminal 62 of the forward most battery 60 to electrically contact conductor 122 of light source assembly 100 to complete an electrical circuit including light source 110. Specifically, and for example, the electrical circuit includes metal contact 220, metal coil spring 226, batteries 60, center conductor 122, electrical device 130, light source 110, outer conductor 126, metal eyelet 150 and housing 20, with the connection between metal contact 220 and housing 20 being breakable to provide switching action.

Tail switch assembly 200 is positioned within tail cap 40 at the rearward end 14 of flashlight 10. Tail switch assembly 200 includes a generally cylindrical pushbutton 210 of insulating plastic that includes a rearward cylindrical section that projects through hole 42 of tail cap 40 and has a circumferential groove 212 in which resilient O-ring 214 resides to provide a water resistant seal between pushbutton 210 and tail cap 40 proximate hole 42 therein. Tail cap 40 includes a cylindrical skirt 48 extending forwardly from internal threads 44 therein and extending along housing 20. Tail cap skirt 48 provides an inner surface for sealing tail cap 40 against O-ring 38, and also provides a greater length to tail cap 40 thereby making it easier to grip for rotating tail cap 40 relative to housing 20 to turn flashlight 10 on and off.

Pushbutton 210 also includes a central cylindrical section having a greater diameter than the rearward section thereof to provide an outwardly extending circular flange 216 that engages a corresponding shoulder 46 of tail cap 40 to retain pushbutton 210 captive therein. Forward cylindrical body section 218 of pushbutton 210 is preferably of lesser diameter than the rearward section and circular flange 216 thereof to receive a cylindrical metal contact ferrule 220 thereon. Metal ferrule 220 receives metal coil spring 226 in the forward cylindrical section thereof and includes circular contact flange 222 extending radially outward therefrom. Radial flange 222 comes into contact with the rearward end of housing 20 when pushbutton 210 is depressed or when tail cap 40 is rotated clockwise with respect to housing 20 to advance axially forward thereon due to the engagement of the external threads 30 on the external surface of housing 20 and the internal threads 44 of tail cap 40. Insulating plastic cylindrical ferrule 230 surrounds metal ferrule 220 and centers tail switch assembly within the central longitudinal cylindrical cavity of housing 20. Preferably, metal ferrule 220 is a tight fit over cylindrical body section 218 of pushbutton 210 and plastic ferrule 230 is a tight fit over metal ferrule 220 for holding together with a slight press fit, without need for adhesive or other fastening means.

Alternatively, body portion 218, metal ferrule 220 and insulating ferrule 230 may each be tapered slightly for a snug fit when slipped over each other, and metal ferrule 220 may be split axially so as to more easily be expanded and compressed for assembly over body portion 218 and securing thereon by ferrule 230. Metal ferrule 220 is preferably brass, but may be copper, aluminum, steel or other formable metal. Coil spring 226 is preferably stainless steel, but may be of steel, beryllium copper or other spring-like metal.

Housing 20 is preferably metal so as to provide an electrically conductive path along the length of flashlight 10. Housing 20 and tail cap 40 are preferably of aluminum, and more preferably of 6000 series tempered aircraft aluminum. Housing 20 and tail cap 40 are preferably coated for aesthetics as well as for preventing oxidation of the aluminum metal, and preferably are coated with a durable material such as an anodized finish or a paint, which is available in attractive colors such as black, silver, gold, red, blue and so forth. While an anodized finish is hard and durable, it is not electrically conductive and so it is removed or not applied at those locations where it is desired to make an electrical circuit through or an electrical connection to housing 20.

Figure 6:
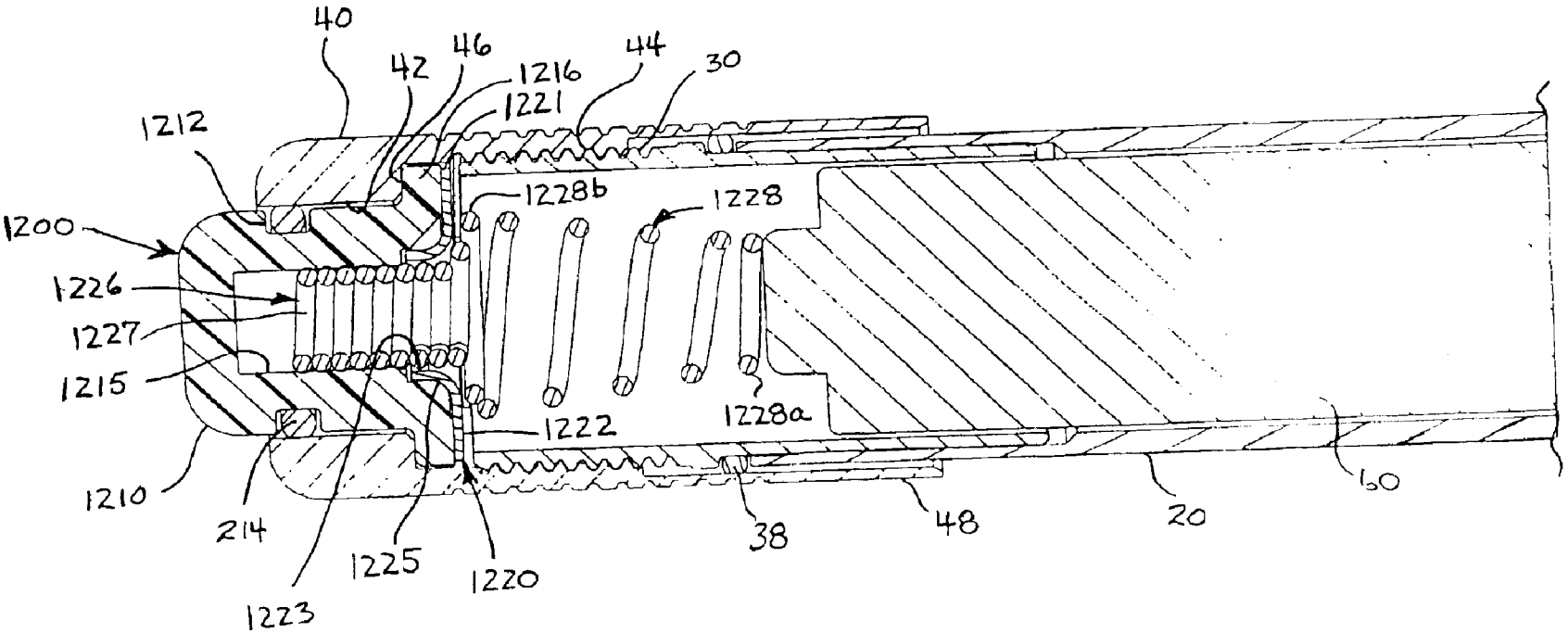
FIG. 6 is an enlarged side cross-sectional view of a portion of the flashlight of FIG. 1 including an alternative embodiment of a switch assembly therefor.

FIG. 6 is an enlarged side cross-sectional view of a portion of the flashlight 10 of FIG. 1 including an alternative and preferred embodiment of a switch assembly 1200 therefor. Tail cap 40 is threaded onto threads 30 of housing 20 and switch assembly 1200 is disposed therein for making selective electrical connection between battery 60 in housing 20 and the end of housing 20. Selective electrical connection between housing 20 and battery 60 is made via spring 1226 and metal contact 1220 when pushbutton 1210 is moved forward towards housing 20 sufficiently for metal contact 1220 to contact the end of housing 20. FIG. 6 illustrates the un-energized or un-actuated condition wherein metal contact 1220 and pushbutton 1210 are urged away from housing 20 by spring 1226, thereby leaving a space or gap between metal contact 1220 and housing 20. The energized or actuated condition obtains when metal contact 1220 is moved forward to contact housing 20 and complete the electrical circuit including batteries 60 and light source 110.

Such forward movement of metal contact 1220 may be provided by depressing pushbutton 1210 to move it and metal contact 1220 forward towards housing 20, which provides a momentary connection while pushbutton 1220 is depressed. A continuous connection may be provided by rotating tail cap 40 relative to housing 20 so that tail cap 40, and pushbutton 1210 and metal contact 1220 therein, advance towards housing 20 due to the external screw threads 30 of housing 20 and the internal threads 44 of tail cap 40, respectively, until metal contact 1220 touches housing 20 and the space or gap is closed. Thus, the switching operation of switch assembly 1200 to selectively energize light source 110 is like that of switch assembly 200 described above.

Figure 7:
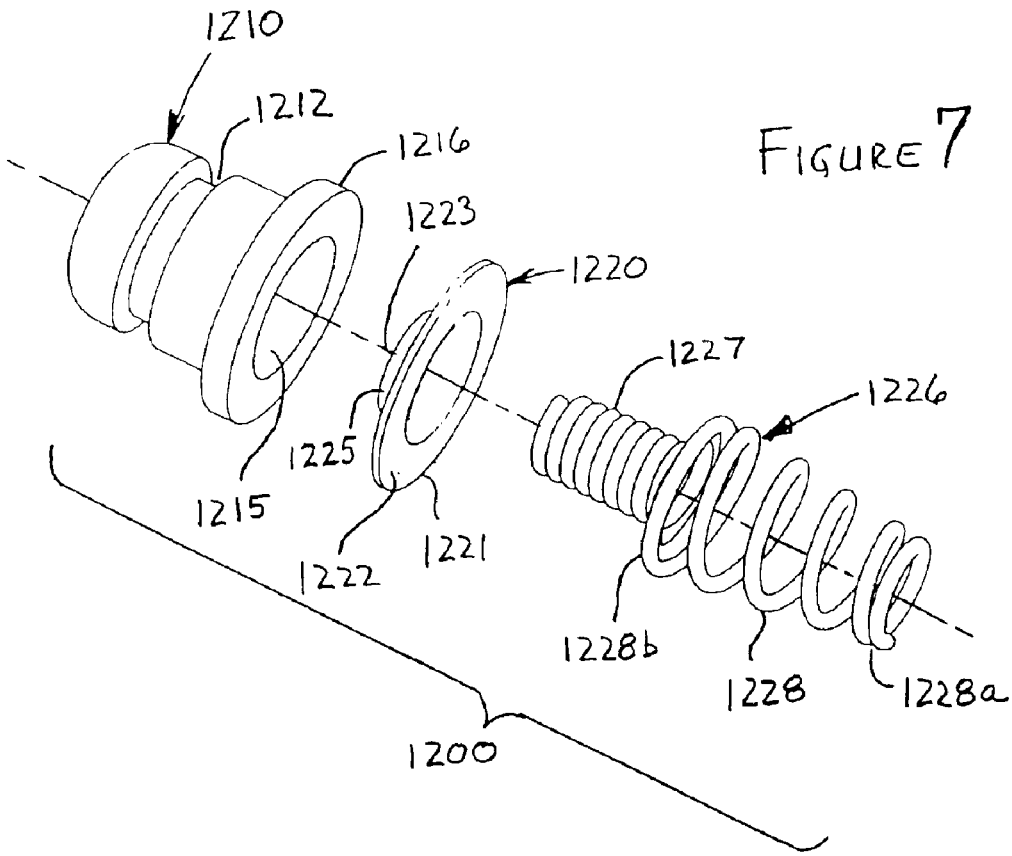
FIG. 7 is an exploded isometric view of the embodiment of the switch assembly of FIG. 6.

Switch assembly 1200 may be understood by considering FIG. 6 in conjunction with FIG. 7 which is an exploded isometric view of the embodiment of switch assembly 1200. Pushbutton 1210 is generally cylindrical and of slightly smaller diameter than the hole 42 of tail cap 40 so as to be axially movable therein. Pushbutton 1210 has an outwardly extending circular flange 1216 against which shoulder 46 of tail cap 40 may bear to limit movement of pushbutton 1210 in the direction away from housing 20. Pushbutton 1210 has an internal cavity or recess or bore 1215 that may provide an engaging feature for receiving a corresponding engaging feature of metal contact 1220 or for receiving a portion 1227 of spring 1226, as described below. Pushbutton 1210 may be of an insulating material or have an insulating coating where tail cap 40 is electrically conductive.

Metal contact 1220 is substantially a flat metal disk that provides selective electrical connection between battery 60 and housing 20. Circular flange 1222 of metal contact 1220 has a circular periphery 1221 and a diameter that is smaller than the diameter of the interior cavity of tail cap 40 and that is at least as great as the interior diameter of the end of housing 20. Preferably, metal contact 1220 has a central hole 1223 in which a portion 1227 of spring 1226 resides to provide electrical contact therebetween. While such contact may be by spring 1226 physically touching metal contact 1220 as is typical, electrically conductive adhesive or solder may be utilized, if desired.

Metal contact 1220 may be a flat metal disk or washer, or may be an eyelet or ferrule, in any case having a circular periphery 1221 and being centered relative to tail cap 40 and/or pushbutton 1210. The centering feature 1225 of contact 1220 is complementary in shape and size to the centering cavity 1215 of pushbutton 1210 so that when the complementary features 1215, 1225, are engaged, the desired relative radial positional relationship obtains.

Spring 1226 urges metal contact 1220 away from battery 60 and housing 20, and because such urging causes metal contact 1220 to bear against pushbutton 1210, pushbutton 1210 is also urged away from battery 60 and housing 20. Preferably, spring 1226 is a coil spring and also preferably, coil spring 1226 has a smaller diameter portion 1227 and a larger diameter portion 1228. An advantage of this coil spring 1226 arrangement is that the coil thereof in the transition between larger diameter portion 1228 and smaller diameter portion 1227 bears against metal contact 1220 to provide positive contact and electrical connection thereto. Also preferably, coil spring 1226 is a so-called "Christmas-tree" spring wherein the smaller diameter portion 1227 is cylindrical and the larger diameter portion 1228 is of non-uniform diameter. In one preferred embodiment, larger diameter portion 1228 of coil spring 1226 is conical with its base **1228*b* bearing against metal contact 1220 and its narrow end 1228*a* contacting battery 60**.

Optionally, but preferably, the diameters of narrow portion 1227 of spring 1226 and of the cavity or bore 1215 of pushbutton 1210 may be selected for a snug or interference fit of spring 1226 in pushbutton 1210, whereby spring 1226 engages the interior surface of the cavity or pushbutton 1210 and so pushbutton 1210, metal contact 1220 and spring 1226 tend to remain together once assembled into switch assembly 1200. Other springs, such as spring 226, for example, could also be employed. It is noted that the urging action of spring 1226 typically causes metal contact 1220 to bear against or abut circular flange 1216 of pushbutton 1210 with the centering projection 1225 engaging the cavity 1215 of pushbutton 1210, thereby tending to center contact 1220 relative to pushbutton 1210.

Metal contact 1220 may be centered with respect to pushbutton 1210 and/or tail cap 40, as is desirable when tail cap 40 is electrically conductive, by one or more of the following means. Cylindrical spring portion 1227 passing through the opening 1223 of metal contact 1220 and into the cavity or bore of pushbutton 1210 may serve to center metal contact 1220. Further, the cavity or recess 1215 of pushbutton 1210 may be shaped or contoured so as to be symmetrical about its central axis and the central region 1225 of metal contact 1220 may be similarly shaped or contoured in a complementary manner. Suitable shapes may include a portion of a sphere, a cone and/or a dome, a dimple or a bevel or a chamfer, or any other shape or contour that provides complementary engaging features on metal contact 1220 and pushbutton 1210, or any other shape that otherwise centers metal contact 1220 relative to pushbutton 1210 or that maintains metal contact 1220 and pushbutton 1210 in predetermined radial positions. Typically, such centering feature is radially symmetric relative to the axial axes of pushbutton 1210 and/or contact 1220. Also typically, the desired radial position of contact 1220 is centered, or substantially coaxial, with respect to pushbutton 1210 and/or tail cap 40.

As illustrated in the embodiment of FIGS. 6 and 7, metal contact 1220 has a flat outward radial flange 1222 for providing a selective electrical contact with housing 20 and has an axial projection 1225 for engaging pushbutton 1210 for providing centering of contact 1220 relative to pushbutton 1210, i.e. so that contact 1220 and pushbutton 1210 are substantially coaxial. It is noted that the centering projection 1225 of metal contact 1220 defines the hole or central opening 1223 therein. It also is noted that the radial positioning, e.g., centering, of metal contact or ferrule 1220 is similar to the radial positioning of metal ferrule 220 relative to pushbutton 210 and/or tail cap 40, as described above.

Flashlight 10 as described provides the advantages of a very small diameter housing 20 and a relatively high intensity light source 110 that has very long useful life, e.g., in excess of 100,000 hours, and operates for a long time, e.g., over 10 hours, on a set of batteries. An additional advantage obtains due to the water resistance provided by O-rings 116, 38 and 214 providing seals between light source assembly 100 and housing 20, between tail cap 40 and housing 20, and between pushbutton 210 and tail cap 40, respectively.

Figure 8:
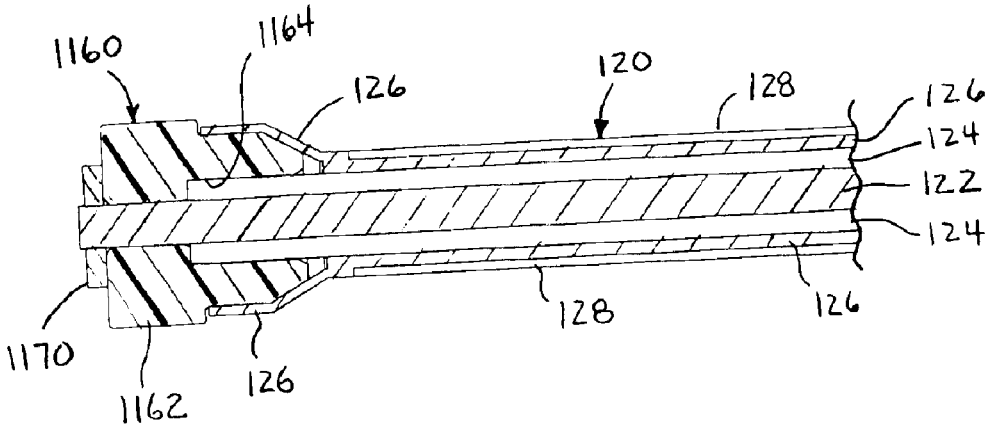
FIG. 8 is a side cross-sectional view of an alternative example embodiment of an end portion of the flexible lighted end of the flashlight of FIG. 1.

FIG. 8 is a side cross-sectional view of an alternative example embodiment of an end portion of the flexible lighted end 120 of the flashlight 10 of FIG. 1. A cylindrical fitting 1160 is disposed on the end of flexible member 120, e.g., a coaxial cable, the end of which has been prepared to receive fitting 1160. Coaxial insulation 124 and braided outer conductor 126 have been removed to expose a short length of center conductor 122 and outer jacket 128 has been removed further to expose an end portion 127 of outer conductor 126.

Fitting 1160 has a cylindrical body 1162 which has a stepped axial bore 1164 that includes a through hole in which center conductor 122 is disposed and a larger diameter portion in which coaxial insulator 124 is disposed. The forward end 1166 of fitting 1160 is shaped, e.g., tapered, and end portion 127 of outer conductor 126 lies over the tapered forward end 1166 of fitting 1160. Fitting 1160 is assembled by being slipped over center conductor 120 with the shaped forward end 1166 thereof being inside of and expanding outer conductor 126. When fitting 1160 is in position, metal eyelet 1170 is placed over the end of conductor 122 and is secured thereon, e.g., by swaging or dimpling of conductor 122 and/or eyelet 1170. Fitting 1160 may be made of any of the materials of which fitting 160 may be made and eyelet 1170 may be made of any of the materials of which eyelet 170 may be made.

The diameter of fitting 1160 and of the forward end thereof is selected to be slightly less than the inner diameter D2 of bore 25 of housing 20 so that when flexible member is inserted therein outer conductor 126 thereof is pressed against the inner surface of bore 25 to make electrical connection thereto. Preferably, fitting 1160 with outer conductor 126 thereover is a press fit into bore 25, and flexible member 120 may be pressed forward so that outer conductor 126 abuts shoulder 27 of housing 20.

While the present invention has been described in terms of the foregoing example embodiments, variations within the scope and spirit of the present invention as defined by the claims following will be apparent to those skilled in the art. For example, split collar 140 at the base end of flexible light assembly 100 could be of an electrically conductive material, such as a metal, in which case split collar 140 would provide electrical connection between outer conductor 126 and housing 20. In such case, eyelet 150 is unnecessary and could be eliminated. Further, extending the length of split collar 140 in the axial direction could provide sufficient positioning of coaxial cable 120 so that fitting 160 could be eliminated and the stripping of cable 120 could be simplified.

In addition, and alternatively, fitting 1160 could be either annular or be split longitudinally similarly to split collar 140 so that it compresses and tends to grip coaxial insulation 124 and center conductor 122 of coaxial cable 120. Further, fitting 1160 could have inwardly extending ridges, teeth or the like similarly to projections 146 of split collar 140.

While a metal housing 20 is preferred, a plastic housing may be employed and may include an electrically conductive member for making electrical connection between light source assembly 100, battery 60 and switch 200. In addition, protective electrical resistor 130 of light source assembly 100 could be eliminated or could be replaced by another electrical device, e.g., a field-effect transistor current limiter, that would limit the current that could flow through LED light source 110 to a safe level.

Alternatively and optionally, pushbutton 1210 may have a circumferential groove 1212 for receiving O-ring 214, and/or housing 20 or tail cap 40 may have a groove for receiving O-ring 38, where it is desired to provide a seal resistant to moisture or other undesirable matter. Also optionally, the larger diameter portion 1228 of spring 1226 may have a greater diameter at end 1228*a* distal smaller diameter portion 1227 than at end 1228*b*.

A clip may be installed onto housing 20 to provide a simple means for securing flashlight 10 in the pocket of a user's garment or apron or the like. In addition, either or both of housing 20 and tail cap 40 may be knurled or spiral grooved to provide a better gripping surface for facilitating the relative rotational movement of housing 20 and tail cap 40 for the turning on and off of flashlight 10.

What is claimed is:

1. A flashlight comprising:

a housing having a bore and a hole at a forward end thereof;

an elongated flexible/bendable member having a first end thereof extending through the hole in said housing from interior the bore thereof, and including at least two electrical conductors extending substantially the length thereof;

securing means disposed around said elongated flexible/bendable member interior the bore of said housing for securing said elongated flexible/bendable member in said housing;

wherein said securing means comprises a split collar compressed in the bore of said housing;

a light source disposed at a second end of said elongated flexible/bendable member distal said housing and connected to the at least two electrical conductors thereof;

at least one battery in said housing; and a switch for selectively connecting said light source and said at least one battery in circuit via the at least two conductors of said elongated flexible/bendable member for causing said light source to produce light.

2. The flashlight of claim 1 wherein said securing means further comprises an electrically conductive eyelet for making electrical connection between one of the at least two conductors of said elongated flexible/bendable member and said housing.

3. The flashlight of claim 1 wherein said split collar is electrically conductive for making electrical connection between one of the at least two conductors of said elongated flexible/bendable member and said housing.

4. The flashlight of claim 1 wherein said split collar is electrically insulating for urging one of the at least two conductors of said elongated flexible/bendable member against said housing.

5. The flashlight of claim 1 wherein said spilt collar has a central opening wherein said elongated flexible/bendable member is disposed.

6. The flashlight of claim 5 wherein the central opening of said split collar has a plurality of projections extending radially inward for engaging said elongated flexible/bendable member.

7. The flashlight of claim 1 wherein said elongated flexible/bendable member includes a length of coaxial cable having a center conductor, and a coaxial outer conductor, and an insulating member therebetween.

8. The flashlight of claim 7 wherein said securing means comprises a cylindrical fitting surrounding at least the center conductor of said coaxial cable.

9. A flashlight comprising:

a housing having a bore and a hole at a forward end thereof;

an elongated flexible/bendable member having a first end thereof extending through the hole in said housing from interior the bore thereof, and including at least two electrical conductors extending substantially the length thereof, wherein said elongated flexible/bendable member includes a length of coaxial cable having a center conductor, and a coaxial outer conductor, and an insulating member therebetween;

securing means disposed around said elongated flexible/bendable member interior the bore of said housing for securing said elongated flexible/bendable member in said housing, wherein said securing means comprises a split coller compressed in the bore of said housing and engaging the outer conductor of said coaxial cable;

a light source disposed at a second end of said elongated flexible/bendable member distal said housing and connected to the at least two electrical conductors thereof;

at least one battery in said housing; and a switch for selectively connecting said light source and said at least one battery in circuit via the at least two conductors of said elongated flexible/bendable member for causing said light source to produce light.

10. The flashlight of claim 9 wherein said coaxial cable includes a jacket on the coaxial outer conductor thereof, and wherein said split collar engages the jacket and the outer conductor of said coaxial cable.

11. The flashlight of claim 9 wherein said securing means further comprises an electrically conductive eyelet for making electrical connection between the outer conductor of said elongated flexible/bendable member and said housing.

12. The flashlight of claim 9 wherein said split collar is electrically conductive for making electrical connection between the outer conductor of said coaxial cable and said housing.

13. The flashlight of claim 9 wherein said split collar is electrically insulating for urging the outer conductor of said coaxial cable against said housing.

14. The flashlight of claim 9 wherein said split collar has a central opening wherein said coaxial cable is disposed.

15. The flashlight of claim 14 wherein the central opening of said split collar has a plurality of projections extending radially inward for engaging said coaxial cable.

16. The flashlight of claim 1 further comprising a current limiting electrical device in circuit with said light source at the distal end of said elongated flexible/bendable member.

17. The flashlight of claim 1 further comprising a molded body for supporting said light source to the second end of said elongated flexible/bendable member.

18. The flashlight of claim 1 further comprising a sleeve overlying at least a portion of said housing and a portion of said flexible/bendable member proximate where said elongated flexible/bendable member extends through the hole in said housing.

19. The flashlight of claim 1 further comprising a tail cap on said housing, wherein said switch includes a pushbutton switch located in said tail cap for selectively connecting and disconnecting said at least one battery and said housing when said pushbutton is pressed and released.

20. An elongated bendable member for a flashlight comprising:

a length of coaxial cable having a center conductor, and a coaxial outer conductor, and an insulating member therebetween extending from a first end to a second end thereof;

a split collar surrounding the outer conductor of said length of coaxial cable for engaging the outer conductor at the first end thereof;

an electrically conductive eyelet for making electrical connection to the outer conductor of said length of coaxial cable at the first end thereof;

a cylindrical fitting surrounding at least the center conductor of said length of coaxial cable at the first end thereof, and a light source disposed at the second end of said length of coaxial cable and connected to the center and outer conductors thereof.

21. The elongated bendable member of claim 20 in combination with a housing having a hole therein, wherein said length of coaxial cable extends through the hole of said housing with the first end of said length of coaxial cable disposed interior said housing.

22. The elongated bendable member of claim 21 wherein said housing further comprises a battery and a switch coupled to the center and outer conductors of said length of coaxial cable for selectively energizing said light source to produce light.

23. The elongated bendable member of claim 20 wherein said coaxial cable includes a jacket on the coaxial outer conductor thereof, and wherein said split collar engages the jacket and the outer conductor of said coaxial cable.

24. The elongated bendable member of claim 20 wherein said split collar has a central opening wherein said coaxial cable is disposed, and wherein the central opening of said split collar has a plurality of projections extending radially inward for engaging said coaxial cable.

25. A method for making a light-producing member comprising:

providing a length of coaxial cable having a center conductor, a coaxial outer conductor, and an insulating member therebetween extending from a first end to a second end thereof;

placing a split collar surrounding the outer conductor of the length of coaxial cable at the first end thereof;

swaging an electrically conductive eyelet to the first end of the length of coaxial cable for making electrical connection to the outer conductor thereof;

placing a cylindrical fitting surrounding at least the center conductor of said length of coaxial cable at the first end thereof proximate the swaged electrically conductive eyelet; and connecting a light source to the center and outer conductors at the second end of the length of coaxial cable.

26. The method of claim 25 further comprises pressing the split collar, the swaged eyelet and the cylindrical fitting into a hollow housing in a press fit.

27. The method of claim 25 further comprising:

providing a hollow housing having a hole at a first end thereof and an opening at a second end thereof;

prior to said connecting a light source, inserting the length of coaxial cable with the split collar, the swaged eyelet and the cylindrical fitting thereon into the opening at the second end of the hallow housing until the second end of the length of coaxial cable extends out of the housing through the hole in the first end thereof; and then said connecting said light source to the center and outer conductors at the second end of the length of coaxial cable.

28. The method of claim 27 wherein said inserting further comprises pressing the split collar, the swaged eyelet and the cylindrical fitting into the hollow housing in a press fit.

29. The method of claim 25 further comprising:

providing a hollow housing having a hole at a first end thereof and an opening at a second end thereof;

inserting the length of coaxial cable with the light source connected thereto into the hole of the hollow housing until the first end of the coaxial cable extends out of the hollow housing through the opening therein;

then, said placing a split collar, said singing an electrically conductive eyelet, and said placing a cylindrical fitting as recited in claim 25.

30. The method of claim 29 further comprising pressing the split collar, the swaged eyelet and the cylindrical fitting into the hollow housing in a press fit.

31. The method of claim 25 further comprising molding a body over the connections of said light source to the center and outer conductors at the second end of the length of coaxial cable.

32. An elongated bendable member for a flashlight comprising:

a length of coaxial cable having a center conductor, and a coaxial outer conductor, and an insulating member therebetween extending from a first end to a second end thereof;

a split collar surrounding the outer conductor and/or the insulating member of said length of coaxial cable at the first end thereof, wherein the coaxial outer conductor of said length of coaxial cable overlies said split collar; and a light source disposed at the second end of said length of coaxial cable and connected to the center and outer conductors thereof.

33. An elongated bendable member for a flashlight comprising:

a length of coaxial cable having a center conductor, and a coaxial outer conductor, and an insulating member therebetween extending from a first end to a second end thereof;

means for making electrical connection to the outer conductor of said length of coaxial cable at the first end thereof including:

a split collar surrounding the outer conductor of said length of coaxial cable for engaging the outer conductor at the first end thereof; and a light source disposed at the second end of said length of coaxial cable and connected to the center and outer conductors thereof.

34. The elongated bendable member of claim 33 wherein said means for making electrical connection further comprises:

an electrically conductive eyelet for making electrical connection to the outer conductor of said length of coaxial cable at the first end thereof; and a cylindrical fitting surrounding at least the center conductor of said length of coaxial cable at the first end thereof.

35. A flashlight comprising:

a hollow housing having a hole at a forward end thereof;

an elongated bendable member having a first end thereof extending through the hole in the forward end of said hollow housing from interior thereof, said elongated bendable member comprising:

a length of coaxial cable having a center conductor, and a coaxial outer conductor, and an insulating member therebetween extending from a first end to a second end thereof;

means for making electrical connection to the outer conductor of said length of coaxial cable at the first end thereof including:

a split collar surrounding the outer conductor of said length of coaxial cable for engaging the outer conductor at the first end thereof; and a light source disposed at the second end of said length of coaxial cable and connected to the center and outer conductors thereof;

a plurality of battery cells in said hollow housing; and a switch on said hollow housing for selectively connecting said light source and said plurality of battery cells in circuit via the center and outer conductors of said elongated bendable member for causing said light source to produce light.

36. A flashlight comprising:

a hollow housing having a hole at a forward end thereof;

an elongated bendable member having a first end thereof extending through the hole in die forward end of said hollow housing from interior thereof, said elongated bendable member comprising:

a length of coaxial cable having a center conductor, and a coaxial outer conductor, and an insulating member therebetween extending from a first end to a second end thereof;

means for inhaling electrical connection to the outer conductor of said length of coaxial cable at the first end thereof including:

a split collar surrounding the outer conductor of said length of coaxial cable for engaging the outer conductor at the first end thereof; and a light source disposed at the second end of said length of coaxial cable and connected to the center and outer conductors thereof;

a plurality of battery cells in said hollow housing; and a switch on said hollow housing for selectively connecting said light source and said plurality of battery cells in circuit via the center and outer conductors of said elongated bendable member for causing said light source to produce light, wherein said means for making electrical connection comprises one or more of:

an electrically conductive eyelet for making electrical connection to the outer conductor of said length of coaxial cable at the first end thereof;

a cylindrical fitting surrounding at least the center conductor of said length of coaxial cable at the first end thereof; and/or the center conductor of said length of coaxial cable overlying said split collar.

37. The flashlight of claim 35 wherein said split collar has a central opening wherein the first end of said length of coaxial cable is disposed, and wherein the central opening of said split collar has a plurality of projections extending radially inward for engaging the first end of said coaxial cable.

38. The flashlight of claim 35 wherein said switch comprises:

a pushbutton having an outward circular flange and a rearward cylindrical body portion of lesser diameter than the circular flange thereof, said pushbutton also having an engaging feature;

a metal contact having an outward circular contact flange and an engaging feature thereon for engaging the engaging feature of said pushbutton, wherein the circular contact flange of said metal contact is proximate the outward circular flange of said pushbutton; and an electrically conductive coil spring disposed for electrically contacting said metal contact and for urging said metal contact and said pushbutton in the same direction.

39. The flashlight of claim 38 wherein said hollow housing is electrically conductive and has a tail cap thereon, and wherein said switch is disposed in said tail cap and is moveable therein for selectively connecting said metal contact and said electrically conductive hollow housing for causing said light source to produce light.

40. A flashlight comprising:

a housing having a cavity for receiving at least one battery;

an elongated flexible member extending from said housing, said elongated flexible member comprising at least two electrical conductors extending substantially the length thereof;

a solid state light source disposed at an and of said elongated flexible member distal said housing and connected to the at least two electrical conductors thereof;

a current limiting electrical device at the distal end of said elongated flexible member connected in circuit with said solid state light source; and a molded body molded at the distal end of said elongated flexible member for supporting said solid state light source and said current limiting electrical device.

41. The flashlight of claim 40 further comprising:

at least one battery disposed in the cavity of said housing; and a switch for selectively connecting said solid state light source and said at least one battery in circuit via the at least two conductors of said elongated flexible member for causing said solid state light source to produce light.

42. The flashlight of claim 40 wherein said at least two electrical conductors of said elongated flexible member comprise an inner conductor and an outer conductor surrounding said inner conductor.

43. The flashlight of claim 40 wherein said solid state light source comprises a light emitting diode and/or wherein said current limiting electrical device comprises a resistance.

44. An elongated bendable member for a flashlight comprising:

a length of an elongated member comprising first and second electrical conductors extending from a first end to a second end thereof, wherein said elongated member is flexible and the first end thereof is adapted for making electrical connection to at least one battery;

a solid state light source at the second end of said length of flexible elongated member and connected to the first electrical conductor thereof;

a current limiting electrical device at the second end of said flexible elongated member in series connection with said solid state light source and with the first and second electrical conductors; and a molded body molded at the second end of said flexible elongated member for supporting said solid state light source and said current limiting electrical device.

45. The elongated bendable member of claim 44 wherein said first and second electrical conductors of said elongated flexible member comprise an inner conductor and an outer conductor surrounding said inner conductor.

46. The elongated bendable member of claim 44 wherein said solid state light source comprises a light emitting diode and/or wherein said current limiting electrical device comprises a resistance.

47. The elongated bendable member of claim 44 in combination with:

a housing having a cavity for receiving at least one battery, wherein the first end of said flexible elongated member extends from said housing;

at least one battery disposed in the cavity of said housing; and a switch for selectively connecting said solid state light source and said at least one battery in circuit via the first and second conductors of said flexible elongated member for causing said solid state light source to produce light.

48. The flashlight of claim 40 wherein said elongated flexible member includes an outer cover, and wherein said molded body overlies a portion of said outer cover.

49. The flashlight of claim 40 wherein said solid state light source includes a base, and wherein said molded body supports the base of said solid state light source.

50. The flashlight of claim 40 wherein said solid stale light source emits white, red, blue, amber or green light.

51. The elongated bendable member of claim 44 wherein said elongated flexible member includes an outer cover, and wherein said molded body overlies a portion of said outer cover.

52. The elongated bendable member of claim 44 wherein said solid state light source includes a base, and wherein said molded body supports the base of said solid slate light source.

53. The elongated bendable member of claim 44 wherein said solid state light source emits white, red, blue, amber or green light.

* * * * *